US011846159B2

(12) United States Patent
Breckenfeld et al.

(10) Patent No.: US 11,846,159 B2
(45) Date of Patent: Dec. 19, 2023

(54) INTEGRATED RETAINING RING AND BUSHING

(71) Applicant: TERELION, LLC, Carrollton, TX (US)

(72) Inventors: Ted Breckenfeld, Carrollton, TX (US); Anthony Plana, Prosper, TX (US)

(73) Assignee: TERELION, LLC, Irving, TX (US)

( * ) Notice: Subject to any disclaimer, the term of this patent is extended or adjusted under 35 U.S.C. 154(b) by 261 days.

(21) Appl. No.: 17/374,073

(22) Filed: Jul. 13, 2021

(65) Prior Publication Data

US 2022/0018386 A1 Jan. 20, 2022

Related U.S. Application Data

(60) Provisional application No. 63/051,438, filed on Jul. 14, 2020.

(51) Int. Cl.
*E21B 4/00* (2006.01)
*E21B 4/14* (2006.01)

(52) U.S. Cl.
CPC ..... *E21B 4/003* (2013.01); *E21B 4/14* (2013.01)

(58) Field of Classification Search
CPC ..... E21B 4/14
See application file for complete search history.

(56) References Cited

U.S. PATENT DOCUMENTS

| | | | | |
|---|---|---|---|---|
| 4,044,844 | A | 8/1977 | Harris et al. | |
| 6,062,322 | A * | 5/2000 | Beccu | B25D 9/04 173/78 |
| 7,757,779 | B2 | 7/2010 | Jacobsson et al. | |
| 8,651,202 | B2 * | 2/2014 | Swadi | C22C 26/00 175/57 |
| 2004/0140131 | A1 * | 7/2004 | Susman | E21B 31/113 175/321 |
| 2005/0173158 | A1 * | 8/2005 | Jacobsson | E21B 4/14 175/296 |
| 2006/0000646 | A1 * | 1/2006 | Purcell | E21B 4/14 175/417 |

FOREIGN PATENT DOCUMENTS

| | | |
|---|---|---|
| CN | 209115038 | 7/2019 |
| WO | 2012049331 A2 | 4/2012 |
| WO | 2019043295 A1 | 3/2019 |

* cited by examiner

*Primary Examiner* — Eyamindae C Jallow
(74) *Attorney, Agent, or Firm* — Corinne R. Gorski

(57) ABSTRACT

A piston actuated drilling tool includes a housing, a top sub, a piston and a drive sub. The piston has a nose at its forward end that is slidably mounted for reciprocating movement within the housing and which strikes a mandrel located at the forward end of the housing. An integrated retaining and bushing system has a retaining ring arranged for preventing the mandrel from detaching from the rest of the tool. The retaining ring encases a bushing for co-operation with the piston nose to stabilise and guide the piston and provide a timing event for percussion of the tool.

8 Claims, 8 Drawing Sheets

INTEGRATED RETAINING RING AND BUSHING

RELATED APPLICATION DATA

This application claims priority of U.S. Provisional Application No. 63/051,438, filed Jul. 14, 2020, which the entirety thereof is incorporated herein by reference.

TECHNICAL FIELD

The present disclosure relates to a piston actuated drilling tool, although not exclusively, to percussion tools for downhole drilling.

BACKGROUND

Piston actuated drilling tools, such as rotary percussion tools (RTP) employ the efficient application of compressed air energy in combination with rotary drilling forces to achieve a high rate of penetration and drilling performance.

Known rotary percussion tools contain a retaining system, for example, in the form of a split retaining ring to prevent the mandrel and the bit from disengaging from the remaining components of the percussion tool, such as the casing.

In some percussion tools there is also a guide bushing provided or a foot valve, to co-operate with the piston nose and regulate the flow around it.

The retaining system and the guide bushing have completely different functions, but are often placed in close proximity to one another, this is shown for example in U.S. Pat. No. 7,757,779 and CN209115038.

The problem with this is that to ensure proper assembly and to maintain their position during operation, it is necessary to very tightly and carefully control the tolerances of the parts, which requires complex machining, which adds further costs and time to achieve the required dimensions.

SUMMARY

It is an objective of the present disclosure to provide a novel and improved assembly for a piston actuated drilling tool for down the hole drilling.

The objective is achieved by providing a piston actuated drilling tool including a housing, a top sub, a piston and a drive sub; the piston having a nose at its forward end that is slidably mounted for reciprocating movement within the housing and which strikes a mandrel located at the forward end of the housing; wherein there is an integrated retaining and bushing system that comprises a retaining ring for preventing the mandrel from detaching from the rest of the tool encasing a bushing for co-operation with the piston nose to stabilise and guide the piston and provide a timing event for the percussion.

The integration of the retaining ring and the bushing means that it is not necessary to maintain such tight tolerances to achieve proper assembly and to maintain the correct positioning of the parts during operation, therefore easing and reducing the cost of the manufacturing process. The integration means that there is no longer the need for complex machining of the housing or the retaining rings. Further, the internal air volume is controlled and so the efficiency of the drilling assembly is improved.

Optionally, the retaining ring is split into at least two parts. This makes it easier to replace the bushing as the retaining ring can just be split apart to remove a worn or damaged bushing and then a new bushing of standard geometry can be inserted.

One or more O-rings are used to hold the multiple sections of the retaining ring together. This provides a simple and reliable method of holding the retaining ring together if it has been split into multiple sections. It is important that the retaining ring is securely held together to prevent the leakage of air which would result in a loss of power or misalignment which would result in excessive wear or broken components.

Alternatively, the retaining ring is a one-piece body. If the retaining ring is a one-piece body, it is easier to manufacture.

The retainer ring can be made of a different material than the bushing. Typically, the retaining ring is made of a stronger material compared to the bushing. Advantageously, this adds structural strength to the integrated retaining and bushing system.

The bushing can be made of a polymer, a glass filled polymer, a non-ferrous metal, a heat treated or coated steel. These materials provide a low friction surface, therefore allowing the piston to be able to freely slide in and out of the bushing whilst minimising wear.

Optionally, at a mating surface within the integrated retaining and bushing system, a radially inner surface of the retaining ring and a radially outer surface of the bushing are both cylindrically flat and parallel to one another. Advantageously, this enables ease of construction.

Alternatively, at a mating surface within the integrated retaining and bushing system, a radially inner surface of the retaining ring and a radially outer surface of the bushing each comprise one of at least one notch and at least one protrusion to form a retention lock within the system. Advantageously, the interlocking geometries means that the two parts of the integrated system are securely held together.

Optionally, the top half and the bottom half of the bushing is asymmetrical, so that the same bushing can be inserted into the retaining ring in a first position for normal operation modes and in a second position for altered timing characteristics, wherein the bushing extends further towards the piston nose in the second position compared the first position. Advantageously, the same bushing can be used in either operational position thus making it is easy and convenient to swap between the two modes, without the need to have to have a second different type of bushing available.

The foregoing summary, as well as the following detailed description of the embodiments, will be better understood when read in conjunction with the appended drawings. It should be understood that the embodiments depicted are not limited to the precise arrangements and instrumentalities shown.

DETAILED DESCRIPTION

Figure 1:
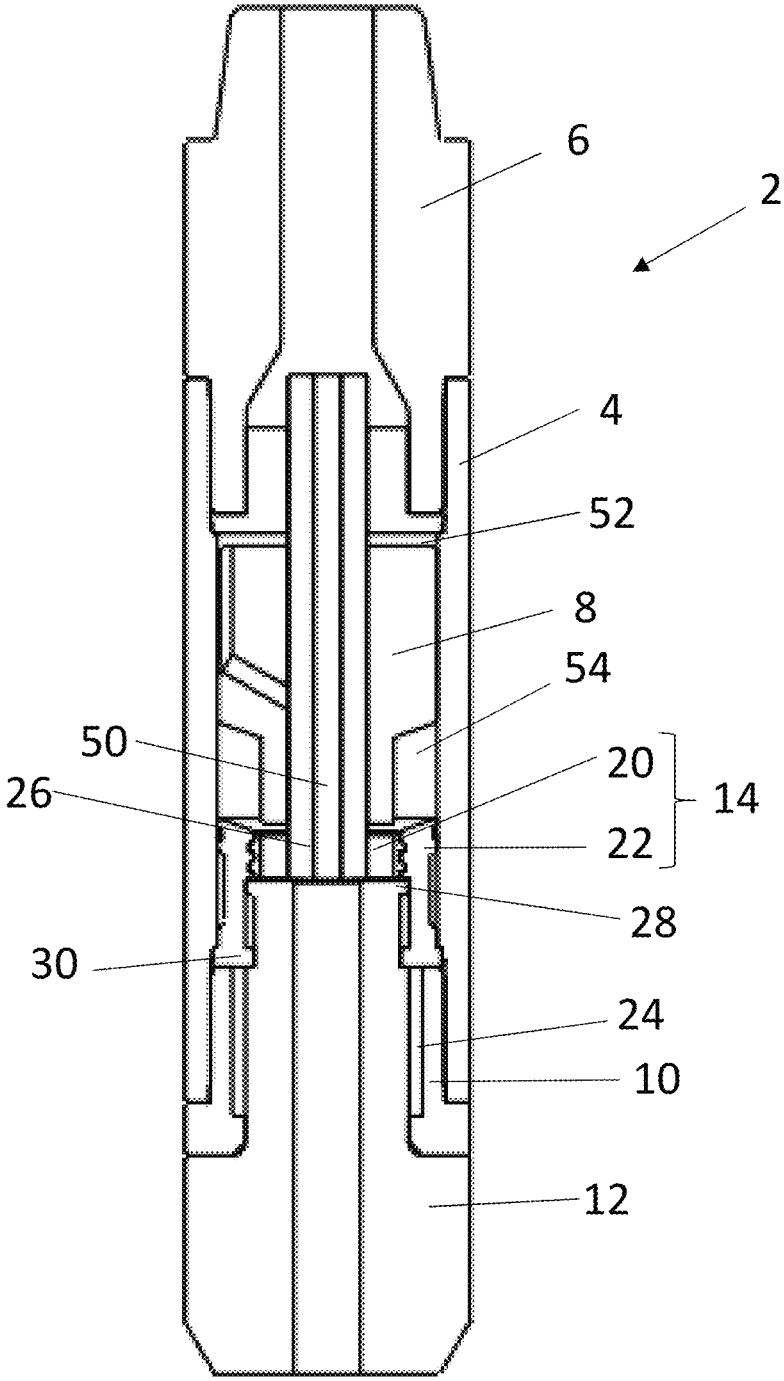
FIG. 1 is a cross-sectional view of a rotary percussion tool hammer according to one embodiment of the present disclosure, wherein the mandrel is in the closed position.

FIG. 1 shows a piston actuated drilling tool 2 for downhole drilling that includes a housing 4 (otherwise known as a cylinder or a casing), a top sub 6 threadedly coupled to the top end of the housing 4 and a drive sub 10 threadedly mounted to the opposing end (the bottom/drive end) of the housing 4.

The tool further includes an annularly shaped piston 8 moveably positioned within the housing 4. The piston 8, which is typically a cylinder although other configurations could be envisaged, optionally includes an air distributor tube 50 extending substantially centrally therethrough for providing air flow to drive the piston 8 and regulate the timing event. Once the tool 2 is assembled, a top pressure fluid chamber 52 and a bottom pressure fluid chamber 54 are formed within the housing 4.

The drive sub 10 houses one or more annularly shaped drive lugs 24 that are stacked on top of one another and a portion of a mandrel 12. The mandrel 12 is a substantially solid component to which a drill bit (not shown), that is provided with a plurality of inserts which are typically made from tungsten carbide, can be attached to. The mandrel 12 is axially moveable with respect to both the housing 4 and the drive sub 10, a portion of the mandrel 12 being inserted and housed within the housing 4. The top sub 6 is threadedly connected to a drill string (not shown), which is connected to a rotation motor on a drilling rig at the surface. Rotational torque is then applied through the rotating assembly including housing 4, drive sub 10, drive lugs 24, and mandrel 12. For DTH hammers the drive lugs 24 are normally replaced by interlocking splines for the transmission of torque. The drive lugs 10 could also be replaced by low friction drive pins to prevent galling.

As the piston 8 slidably moves upward towards the top sub 6, the volume of the top pressure fluid chamber 52 decreases, while the volume of the bottom pressure fluid chamber 54 increases. Conversely, as the piston 8 slidably moves downward towards the mandrel 12, the volume in the top pressure fluid chamber 52 increases and the volume in the bottom fluid chamber 54 decreases.

Figure 2:
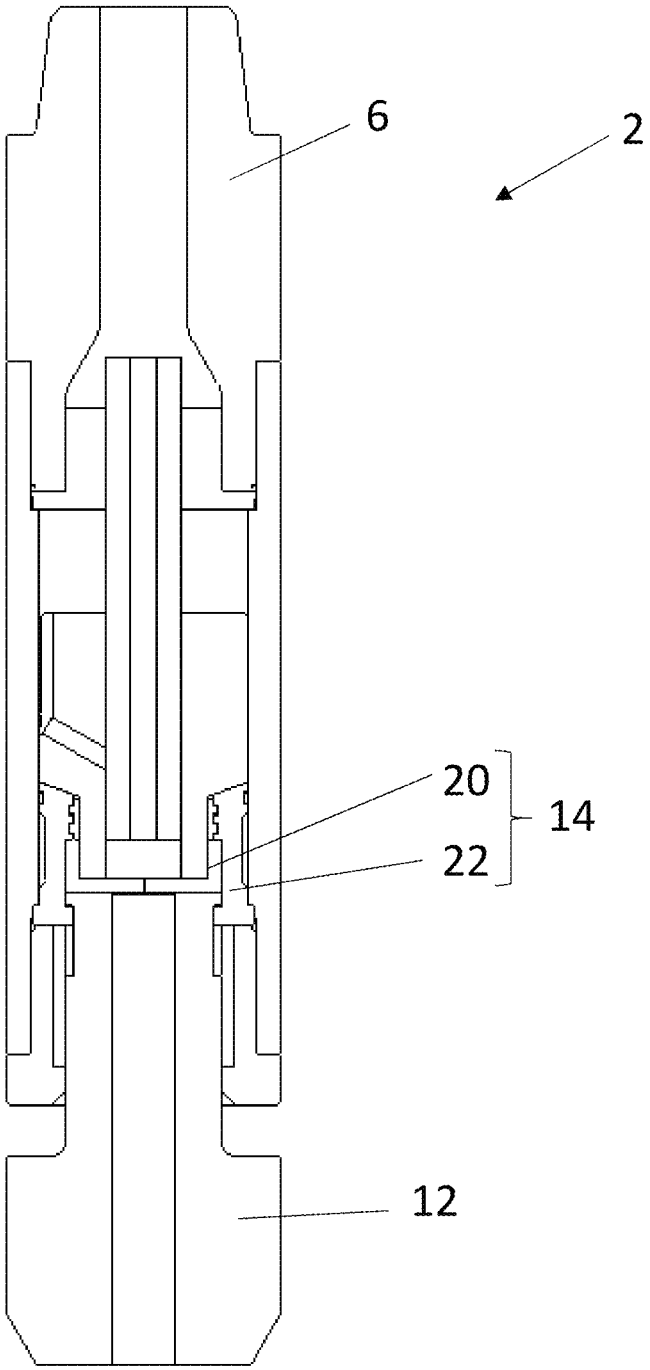
FIG. 2 is a cross-sectional view of a rotary percussion tool hammer according to one embodiment of the present disclosure, wherein the mandrel is in the open position.
Figure 3:
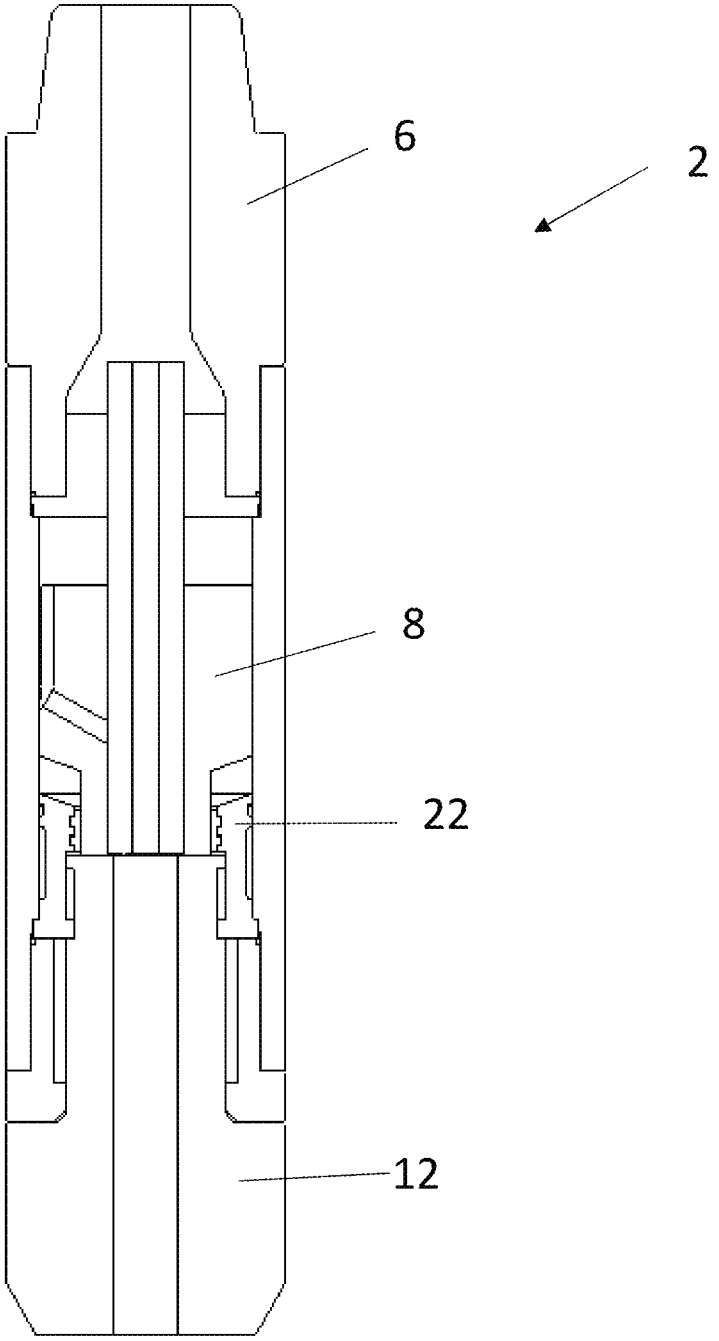
FIG. 3 is a cross-sectional view of a rotary percussion tool hammer according to one embodiment of the present disclosure, wherein the mandrel is closed and the piston is positioned on the mandrel.

The piston 8 is used to deliver a downward force to onto the mandrel 12 when the bottom end of the piston 8 contacts the mandrel 12. The piston 8 is then forced back up and then the cycle continues. FIG. 1 shows the mandrel in the closed position. FIG. 2 shows the same drilling tool 2 as shown in FIG. 1 but with the mandrel in the open position and so that the retaining ring 22 can be seen retaining mandrel 12. FIG. 3 shows the same drilling tool 2 as shown in FIGS. 1 and 2 but with the mandrel 12 closed and piston 9 positioned on the mandrel 12.

Figure 4A:
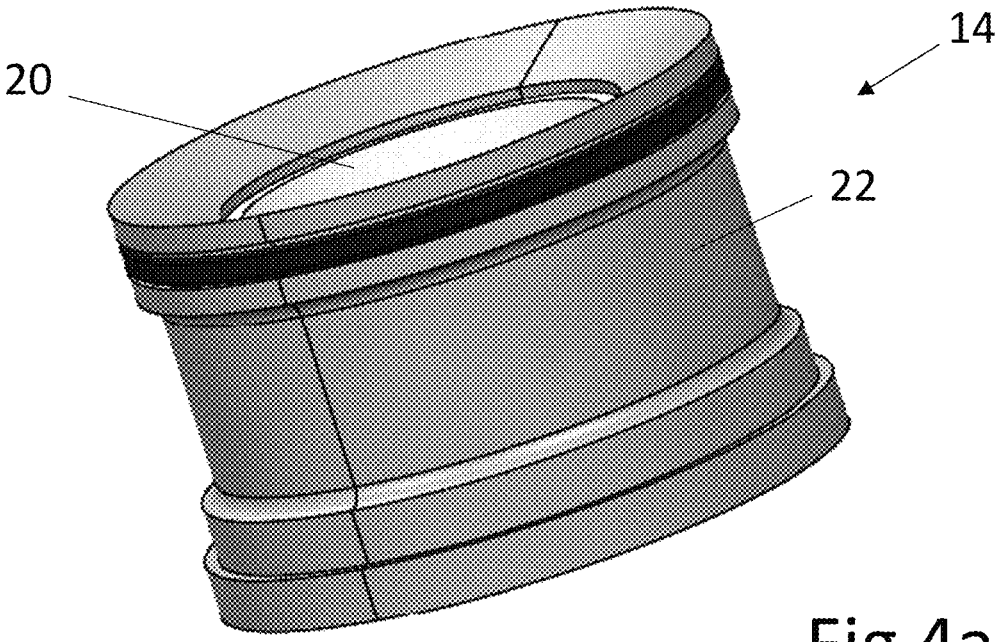
FIGS. 4A and 4B show a perspective view (FIG. 4A) and an exploded view (FIG. 4B) of the integrated retaining and bushing system according to one embodiment wherein the retaining ring is split.
Figure 4B:
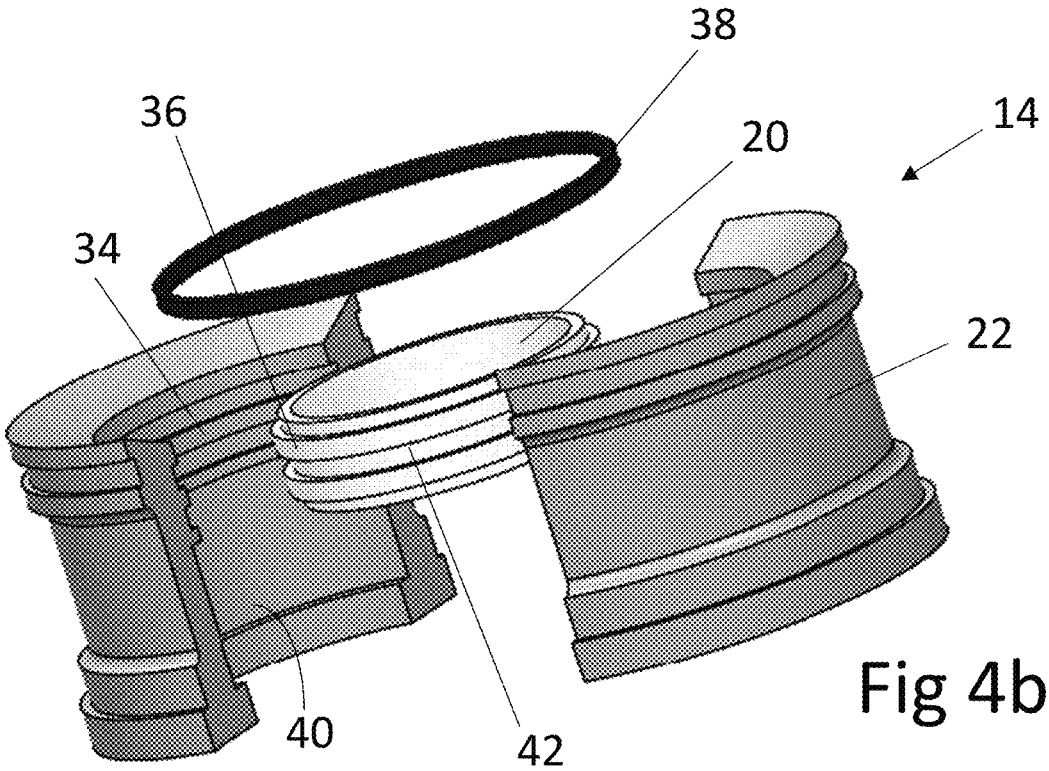

FIG. 4*a* shows a perspective view and FIG. 4*b* shows an exploded view of an integrated retaining and bushing system 14 for an annular bushing 20 (otherwise known as an aligner) and a retaining ring 22. The bushing 20 is typically made from a polymer, a glass filled polymer, non-ferrous metal, a heat treated or coated steel and is a standard part that is readily available and does not need to be formed to a specific tight tolerance. The bushing 20 is encased inside the retaining ring 22, which is also annularly shaped. The retaining ring 22 is typically made from stronger material than the bushing 20, for example a ferrous metal.

The integrated retaining and bushing system 14 are stacked on top of the drive sub 10 and has a dual function.

It should be appreciated that the bushing 20 described in the present application performs a similar function as an exhauster used in a RPS system or a foot valve used in a DTH drill or the geometry of a valveless DTH hammer.

Firstly, the retaining ring 22 part of the system 14 functions to prevent the mandrel 12 and the bit (not shown) from disengaging from the remaining components of the piston actuated drilling tool 2, such as the housing 4. This is achieved through engagement cooperation between a radial protrusion 28 of the upper end of the mandrel 12 and a shoulder 30 on the lower end of the retaining ring 22. The mandrel 12 slidably engages with the retaining ring 22 part of the system 14. When an upward force is placed onto the bottom of the bit, the mandrel 12 slidably moves toward the top sub 6 such that the top portion of the mandrel 12 and the retaining ring 22 are not adjacent and/or in contact with one another. Conversely, when an upward force is not placed onto the bottom of the bit, the mandrel 12 slidably moves away the top sub 6 such that the top portion of the mandrel 12 and the retaining ring 22 are adjacent and/or in contact with one another.

The retaining ring 22 is optionally split as shown in the FIGS. 4A and 4B, for example, it could be formed in two half annular parts for ease of assembly, but it could also be split further into more than two parts. If the retaining ring 22 is split, an O-ring 38 is used as an assembly aid and also provides the benefit of reducing the bypass of air between the retaining ring 22 and the housing 4. Alternatively, the split sections of the retaining ring 22 could be held together using a different method, such as locking bands or through-bolts.

Figure 5:
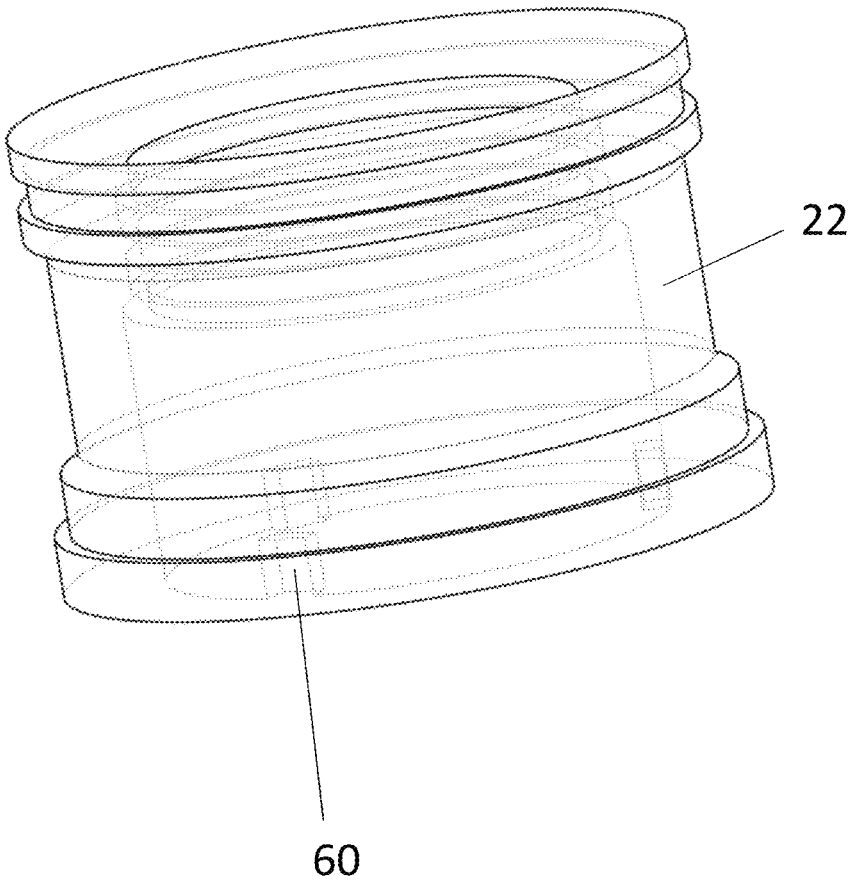
FIG. 5 shows a perspective view of the integrated retaining and bushing wherein the retaining ring is a one-piece body.
Figure 6:
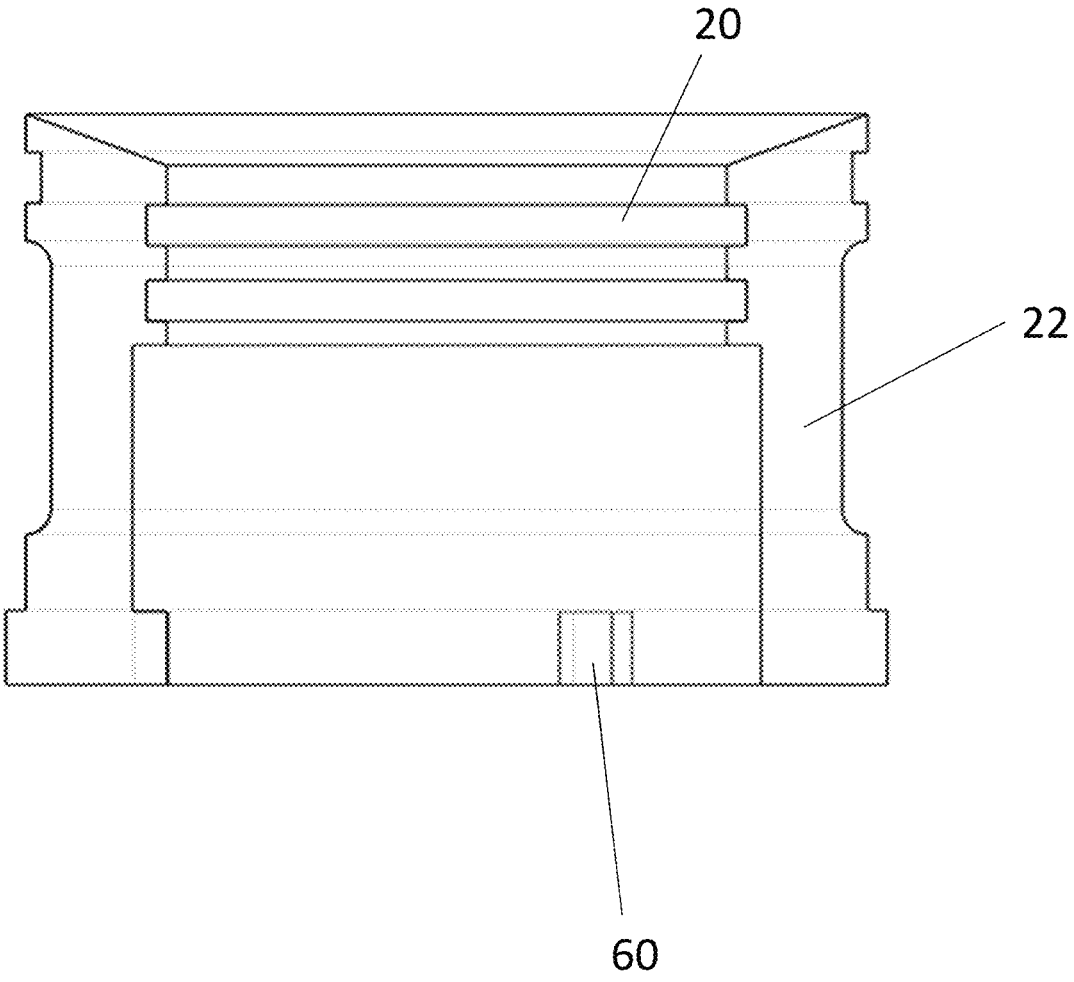
FIG. 6 shows a cross-sectional view of the integrated retaining and bushing system wherein the retaining ring is a one-piece body.
Figure 7:
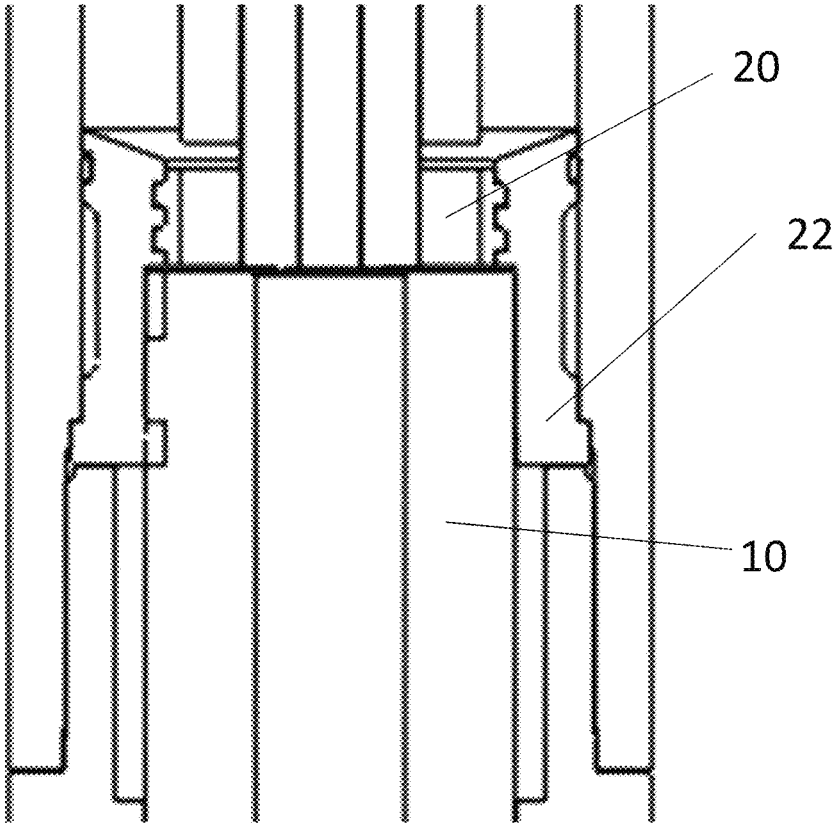
FIG. 7 shows a cross-sectional view of the interlock between the integrated retaining and bushing system and the mandrel wherein the retaining ring is a one-piece body.

FIGS. 5-7 show that alternatively the retaining ring 22 is formed as a one-piece body. If a one piece body retaining ring 22 is used it may have an internal catch 60 to retain it in place, alternatively a circlip or pin or other suitable retainment method could be used. FIGS. 5 and 6 show the perspective view and cross sectional view of the retaining ring 22 as a one-piece body respectively. FIG. 7 shows one possible interlock between the integrated retaining and bushing system 14 and the mandrel 12 having an internal catch 60 when the one piece body retaining ring 22 is employed, this is more likely to be used on a DTH hammer wherein a traditional spline system is used. The retaining ring 22, whether split or a one-piece body, is typically made from a ferrous steel.

Secondly, the bushing 20, which is used in place of a foot valve, is arranged to co-operate with a nose 26 of the piston 8. A purpose of the bushing 20 is to align the top of the mandrel 12 with the piston nose 26 to help stabilise and guide and provide a timing event for the piston 8. A lower annular volume is formed between the piston 8 and the bushing 20 in the bottom pressure fluid chamber 54. When the piston 8 rises out of the bushing 20, the piston 8 exhausts the volume of air. Further, the bushing 20 acts as a seal to prevent the lower annular volume of air that pushes the piston 8 from escaping. This is important because any loss of air volume would reduce the efficiency of the tool 2. The bushing 20 is typically a one-piece body, i.e. not split. Further, the bushing 20 can be made from a low friction material such as a polymer, a glass filled or reinforced polymer, non-ferrous metal, a heat treated or coated steel.

Optionally, the mating surfaces between a radially inner surface 40 of the retaining ring 22 a radially outer surface 42 of the bushing 20 are both cylindrically flat and parallel to one another. Alternatively (as shown in FIGS. 4A and 4B), the mating surfaces between the radially inner surface 40 of the retaining ring 22 and the radially outer surface 42 of the bushing 20 each comprise one of at least one notch 34 and at least one protrusion 36 to form a retention lock within the system 14. The one or more notches 34 could be in the retaining ring 22 and the one or more protrusions 36 could be in the bushing 20 as shown or the one or more protrusions 36 could be in the retaining ring 22 and the one or more notches 34 could be in the bushing 20 or any other combination so that the mating surface between the radially inner surface 40 of the retaining ring 22 a radially outer surface 42 of the bushing 20 forms an interlock. Alternatively, the radially inner surface 40 of the retaining ring 22 a radially outer surface 42 of the bushing 20 could have a tapered geometry, a mechanical fastener, be coated with an adhesive, dimensions for a press fit, have a textured surface or have any other suitable interface. Any type of mating surface geometry, i.e. flat and parallel or interlocking or otherwise, can be combined with the retaining ring 22 being split or being a one-piece body.

Figure 8:
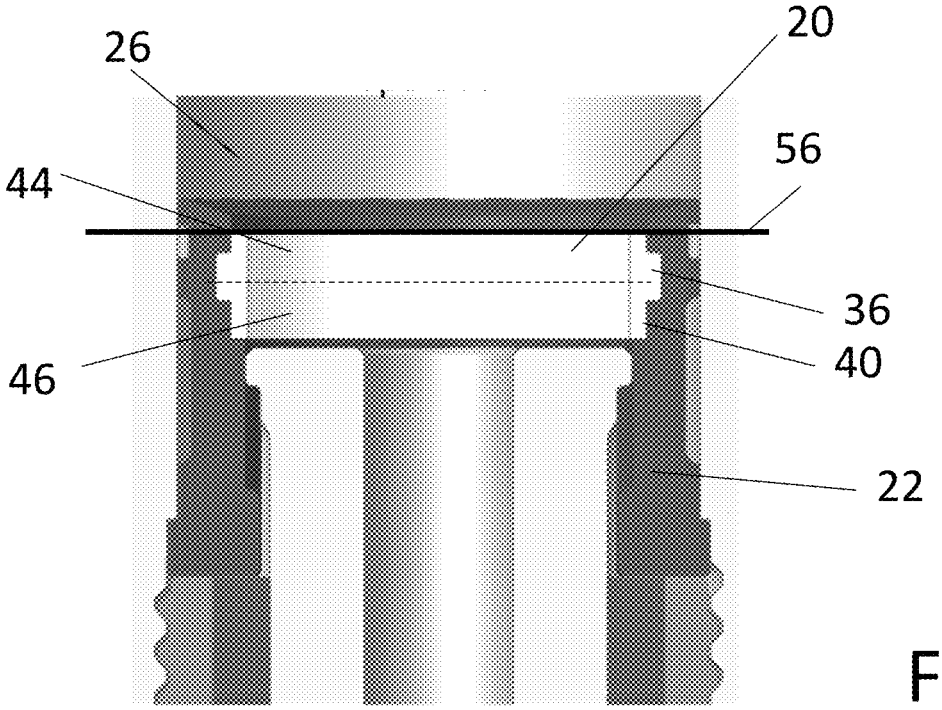
FIG. 8 is a cross-sectional view of an asymmetric bushing according to one embodiment of the present disclosure, wherein the bushing is installed for a first operation mode.
Figure 9:
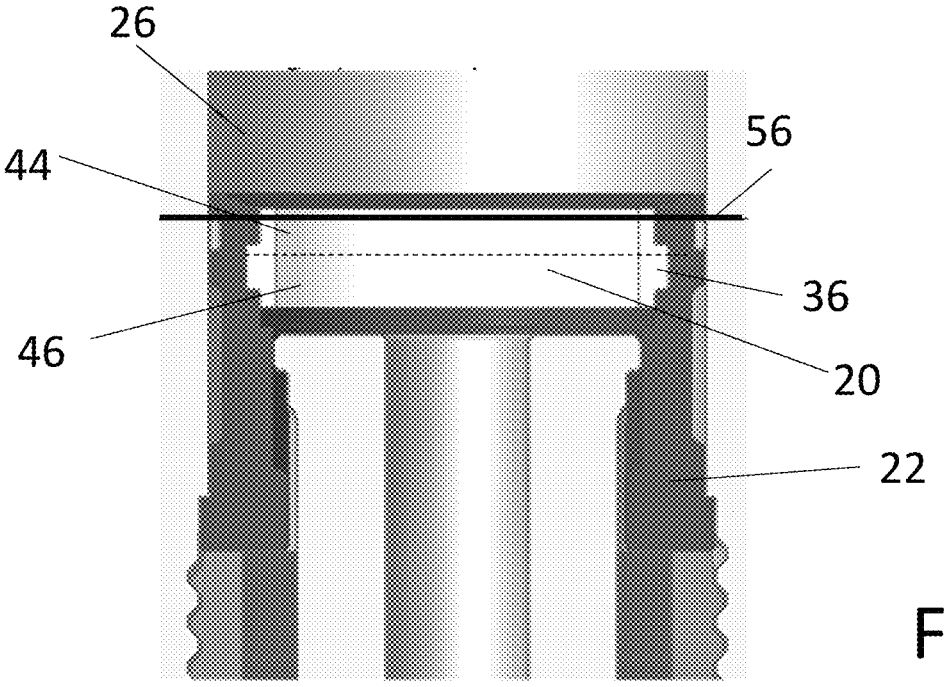
FIG. 9 is a cross-sectional view of an asymmetric bushing according to one embodiment of the present disclosure, wherein the bushing is installed for an alternative operation mode.

FIGS. 8 and 9 show that optionally, the bushing 20 could have an asymmetric geometry, wherein there is at least one notch 34 or at least one protrusion 36 positioned on the radially outer surface 40, such that a top half 44 of the bushing 20 and a bottom half 46 of the bushing 20 are asymmetrical. This means that when the bushing 20 is inserted in a first position, as shown in FIG. 8, the bushing 20 does not extend as close to the nose 26 of the piston 8 as does when the bushing is flipped over and reinserted in a second position, as shown in FIG. 9. FIG. 8 illustrates how the bushing would be installed for use under a first operational mode. FIG. 9 illustrates how the bushing would be installed for a second, alternative operational mode. When the bushing is installed for the second operational mode the bushing 20 extends closer to the nose 26 of the piston 8, and thus changes the operational characteristics according the environmental or input variations or restrictions thereof. The distance above a line 56 shown on FIG. 8 illustrates the additional distance that the bushing 20 extends towards the nose 26 of the piston 8 in second operational mode compared to the first operational mode.

It should be appreciated that the piston actuated drilling tool 2 described hereinabove could be a rotary percussion tool wherein a tri-cone bit is attached to the mandrel 12 or it could be a down the hole (DTH) hammer having a fixed face bit. The integrated retaining and bushing system 14 would function in the same way in a rotary percussion tool or a DTH hammer or indeed any other pneumatically or hydraulically operated hammer.

While the forgoing examples are illustrative of the principles in one or more particular applications, it will be apparent to those of ordinary skill in the art that numerous modifications in form, usage and details of implementation can be made without the exercise of inventive faculty, and without departing from the principles and concepts of the present disclosure. Accordingly, it is not intended that the present disclosure be limited, except as by the claims set forth below.

What is claimed is:

1. A piston actuated drilling tool comprising:

a housing;

a top sub;

a piston having a nose at a forward end that is slidably mounted for reciprocating movement within the housing and which strikes a mandrel located at a forward end of the housing;

a drive sub; and an integrated retaining and bushing system including a retaining ring arranged for preventing the mandrel from detaching from the tool, the retaining ring encasing a bushing for co-operation with the piston nose to stabilize and guide the piston, wherein the retaining ring is split into at least two parts.

2. The piston actuated drilling tool according to claim 1, wherein, one or more O-rings are used to hold the at least two parts of the retaining ring together.

3. The piston actuated drilling tool according to claim 1, wherein the retaining ring is a one-piece body.

4. The piston actuated drilling tool according to claim 1, wherein the retaining ring is made of a different material than the bushing.

5. The piston actuated drilling tool according to claim 1, wherein the bushing is selected from: a polymer, a glass filled or reinforced polymer, a non-ferrous metal, and a heat treated or coated steel.

6. The piston actuated drilling tool according to claim 1, wherein mating surfaces between a radially inner surface of the retaining ring and a radially outer surface of the bushing are both cylindrically flat and parallel to one another.

7. The piston actuated drilling tool according to claim 1, wherein mating surfaces between a radially inner surface of the retaining ring and a radially outer surface of the bushing each include one of at least one notch and at least one protrusion to form a retention lock within the system.

8. The piston actuated drilling tool according to claim 7, wherein a top half and a bottom half of the bushing are asymmetrical, such that a respective bushing can be inserted into the retaining ring in a first position for a first operational mode and in a second position for second operational mode, wherein the bushing extends further towards the piston nose in the second position than the first position.

* * * * *